US006846233B2

(12) United States Patent
Nonogawa et al.

(10) Patent No.: US 6,846,233 B2
(45) Date of Patent: Jan. 25, 2005

(54) SEGMENTAL TYPE GRINDING WHEEL

(75) Inventors: Takeshi Nonogawa, Toki (JP); Tomoharu Kondo, Nagoya (JP)

(73) Assignee: Noritake Co., Limited, Nagoya (JP)

( * ) Notice: Subject to any disclaimer, the term of this patent is extended or adjusted under 35 U.S.C. 154(b) by 0 days.

(21) Appl. No.: 10/360,871

(22) Filed: Feb. 10, 2003

(65) Prior Publication Data

US 2003/0153257 A1 Aug. 14, 2003

(30) Foreign Application Priority Data

Feb. 12, 2002 (JP) ..... 2002-033781

(51) Int. Cl.[7] ..... B24B 1/00

(52) U.S. Cl. ..... 451/542; 451/542; 451/544; 51/298; 125/15

(58) Field of Search ..... 451/541, 542, 451/544; 51/298; 125/15

(56) References Cited

U.S. PATENT DOCUMENTS

| | | | | | |
|---|---|---|---|---|---|
| 3,657,845 | A | * | 4/1972 | Sekiya | 451/541 |
| 5,079,875 | A | * | 1/1992 | Unno et al. | 451/541 |
| 6,019,668 | A | * | 2/2000 | Ramanath et al. | 451/41 |
| 6,074,278 | A | * | 6/2000 | Wu et al. | 451/28 |
| 6,450,870 | B2 | * | 9/2002 | Ito | 451/542 |

FOREIGN PATENT DOCUMENTS

| | | | | | |
|---|---|---|---|---|---|
| EP | 129824 | A2 | * | 9/2001 | 451/542 |
| JP | A 3-79277 | | | 4/1991 | |
| JP | A 3-234474 | | | 10/1991 | |
| JP | 404294978 | A | * | 10/1992 | 451/542 |
| JP | B2 7-8474 | | | 2/1995 | |
| JP | B2 7-16882 | | | 3/1995 | |
| JP | A 8-90424 | | | 4/1996 | |
| JP | A 8-112768 | | | 5/1996 | |
| JP | 410286776 | A | * | 10/1998 | 451/542 |
| JP | 11104965 | A | * | 4/1999 | 451/542 |
| JP | 411235667 | A | * | 8/1999 | 451/542 |
| JP | A 2001-246567 | | | 9/2001 | |
| JP | 2002018722 | A | * | 1/2002 | 451/542 |
| JP | 2003136411 | A | * | 5/2003 | 451/542 |

* cited by examiner

*Primary Examiner*—Joseph J. Hail, III
*Assistant Examiner*—Anthony Ojini
(74) *Attorney, Agent, or Firm*—Oliff & Berridge, PLC

(57) ABSTRACT

A grinding wheel of segmental type including an inner cylindrical core portion, and an outer grinding portion consisting of a plurality of segments which have abrasive layers formed of abrasive grains bonded together with a glass bonding agent and which are bonded to an outer circumferential surface of the core portion with a synthetic resin layer interposed therebetween, wherein a linear thermal expansion coefficient $\alpha_{seg}$ (/° C.) of the segments and a linear thermal expansion coefficient $\alpha_{cor}$ (/° C.) of the core portion satisfy a formula $|(\alpha_{cor}-\alpha_{seg})| \leqq 6\times10^{-6}$.

4 Claims, 4 Drawing Sheets

SEGMENTAL TYPE GRINDING WHEEL

This application is based on Japanese Patent Application No. 2002-033781, the contents of which are incorporated hereinto by reference.

BACKGROUND OF THE INVENTION

1. Field of the Invention

The present invention relates in general to an improvement of a grinding wheel of segmental type including an inner annular or cylindrical core portion and an outer grinding portion consisting of a plurality of segments which are bonded to the outer circumferential surface of the core portion such that the segments are arranged in the circumferential direction of the core portion.

2. Discussion of Related Art

There is known a segmental type of grinding wheel including an inner annular or cylindrical core portion and an outer grinding portion consisting of a plurality of segments which are bonded to the outer circumferential surface of the core portion such that the segments are arranged in the circumferential direction of the core portion. Each segment has a layer of abrasive grains. In operation, the grinding wheel is rotated about an axis of the cylindrical core portion, with an annular array of the segments being held in contact with a surface of a workpiece, so that the workpiece surface is ground by the abrasive grains of the segments. The grinding wheel takes the form of this segmented grinding wheel wherein the segments are arranged for contact with the workpiece surface to be ground, in most cases where the abrasive layer serving to perform a grinding operation on the workpiece is formed of a so-called "super abrasive" such as diamond abrasives or CBN abrasives, which have a comparatively long service life and are more expensive than ordinary abrasives such as alumina abrasives or silicon carbide abrasives. As one kind of the segmental type grinding wheel, there is known a grinding wheel including a cylindrical core portion and a plurality of segments which have abrasive layers formed of abrasive grains bonded together with a glass bonding or binding agent and which are bonded to the outer circumferential surface of the core portion with a synthetic resin layer interposed therebetween. Since this kind of segmental type grinding wheel using the glass bonding agent permits a grinding operation with a high degree of accuracy and has excellent properties such as high durability, this segmental type grinding wheel is used in various fields of industry, and has been an object of further research and development for further improvement of its grinding performance.

Conventionally, the segmental type grinding wheel is usually operated at a peripheral speed of not higher than 4800 m/min. The grinding wheel is generally rotated under a non-load condition for some length of time, for example, during a warm-up period of a grinding machine prior to an actual grinding operation thereof, or during an interruption of the actual grinding operation. The temperature of the grinding wheel during the non-load operation at a peripheral speed as indicated above is almost equal to or slightly higher than the ambient temperature, for instance, the temperature of a coolant used for cooling a worktable of the grinding machine.

When the grinding wheel is operated at a peripheral speed of 4800 m/min or higher, the temperature of the grinding wheel during the non-load operation is raised to a comparatively high level. The graph of FIG. 1 indicates a relationship between the time (min) of operation of the grinding wheel under the non-load condition at a peripheral speed of 12000 m/min and the temperature (° C.) at the surface of the grinding wheel. As indicated by this graph, the surface temperature of the grinding wheel simply rises with an increase in the time of the non-load operation at that peripheral speed. The surface temperature rises to a comparatively high level of about 70° C. when the non-load operation of the grinding wheel has been performed for about one hour. Generally, the segments of the segmental type grinding wheel are bonded to the core portion with a synthetic resin bonding agent such as an epoxy resin, which has a tendency that the bonding strength decreases with an increase in the temperature of the grinding wheel. To prevent a decrease in the bonding strength of the synthetic resin bonding agent during the non-load operation of the segmental type grinding wheel at a comparatively high peripheral speed, it is a conventional practice to continue a supply of the coolant to the grinding wheel even in its non-load operation, for avoiding an excessive rise of the temperature of the grinding wheel. Thus, it is conventionally required to continue the coolant supply even in a period of time in which the grinding wheel is not engaged in an actual grinding operation on the workpiece.

As one means for assuring a sufficiently high bonding strength of a synthetic resin bonding agent such as an epoxy resin bonding agent of two-liquid mixture type, it is known to harden or cure the synthetic resin bonding agent in an atmosphere having a temperature as high as possible. The synthetic resin bonding agent cured at such a high temperature has a sufficiently high bonding strength even after the temperature of the grinding wheel has been raised to a level close to the curing temperature. On the other hand, however, the segmental type grinding wheel using a synthetic resin bonding agent cured at such a comparatively high temperature suffers from a tendency of easy breakage or cracking of the segments during transportation or storage of the grinding wheel.

The present inventors made an extensive study in an effort to solve the drawbacks of the known segmental type grinding wheel which have been discussed. The study revealed that the tendency of easy breakage or cracking of the segments of the segmental type grinding wheel in which the synthetic resin bonding agent is cured at a comparatively high temperature is caused by a compressive strain induced in the segments due to thermal contraction of the segments, which in turn is caused by a temperature drop of the segments from the curing temperature of the synthetic resin bonding agent. Namely, the inventors arrived at a finding that the segments of the known segmental type grinding wheel tend to suffer from easy breakage or cracking during transportation or storage of the grinding wheel, since the segments are subjected to a considerably large compressive strain due to a temperature drop of the segments from the comparatively high curing temperature of the synthetic resin bonding agent, in the presence of a considerably large difference in the coefficient of thermal expansion (coefficient of linear thermal expansion) between the segments and the core portion.

SUMMARY OF THE INVENTION

The present invention was made in view of the background art discussed above. It is therefore an object of the present invention to provide a grinding wheel of segmental type which assures a sufficiently high degree of operating safety at an elevated temperature during its non-load operation, for example, and which does not suffer from breakage or cracking during storage thereof, for example.

The object indicated above may be achieved according to any one of the following modes of the present invention, each of which is numbered like the appended claims and depends from the other mode or modes, where appropriate, to indicate and clarify possible combinations of elements or technical features. It is to be understood that the prevent invention is not limited to the technical features or any combinations thereof which will be described for illustrative purpose only. It is to be further understood that a plurality of elements or features included in any one of the following modes of the invention are not necessarily provided all together, and that the invention may be embodied without some of the elements or features described with respect to the mode concerned.

(1) A grinding wheel of segmental type including an inner cylindrical core portion, and an outer grinding portion consisting of a plurality of segments which have abrasive layers formed of abrasive grains bonded together with a glass bonding agent and which are bonded to an outer circumferential surface of the core portion with a synthetic resin layer interposed therebetween, wherein the plurality of segments have a linear thermal expansion coefficient $\alpha_{seg}$ (/° C.) while the core portion has a linear thermal expansion coefficient $\alpha_{cor}$ (/° C.), the linear thermal expansion coefficient $\alpha_{seg}$ (/° C.) and the linear thermal expansion coefficient $\alpha_{cor}$ (/° C.) satisfying a formula $|(\alpha_{cor}-\alpha_{seg})| \leqq 6\times10^{-6}$.

In the present segmental type grinding wheel of the present invention wherein the linear thermal expansion coefficient $\alpha_{seg}$ of the segments and the linear thermal expansion coefficient $\alpha_{cor}$ of the core portion are determined to be sufficiently close to each other, so as to satisfy the above-indicated formula $|(\alpha_{cor}-\alpha_{seg})| \leqq 6\times10^{-6}$, the segments will not be subjected to an excessive amount of compressive strain, even where the synthetic resin layer is cured in an atmosphere having a comparatively high temperature, so that the segments will not suffer from breakage, cracking or any other drawbacks. Accordingly, the segmental type grinding wheel according to the present invention has a sufficiently high degree of operating safety at an elevated temperature during its non-load operation, for example, and does not suffer from breakage or cracking during storage thereof, for example.

(2) A grinding wheel of segmental type according to the above mode (1), wherein the linear thermal expansion coefficient $\alpha_{seg}$ (/° C.) of the segments and the linear thermal expansion coefficient $\alpha_{cor}$ (/° C.) of the core portion satisfy a formula $|(\alpha_{cor}-\alpha_{seg})| \leqq 5\times10^{-6}$.

In the grinding wheel according to the above mode (2) wherein the linear thermal expansion coefficient $\alpha_{seg}$ of the segments and the linear thermal expansion coefficient $\alpha_{cor}$ of the core portion are determined so as to satisfy the above-indicated formula $|(\alpha_{cor}-\alpha_{seg})| \leqq 5\times10^{-6}$, breakage or cracking of the segments due to an excessive compressive strain can be effectively prevented even where the synthetic resin layer is cured in an atmosphere having a temperature of 90° C. or higher, for instance.

(3) A grinding wheel of segmental type according to the above mode (1) or (2), wherein the synthetic resin layer is formed of an epoxy resin bonding agent cured in an atmosphere having a temperature not lower than 70° C.

In the above mode (3) of the invention wherein the synthetic resin layer is formed of an epoxy resin bonding agent which is cured at a temperature of 70° C. or higher, the synthetic resin layer provides a sufficiently high bonding force, assuring a high degree of operating safety of the grinding wheel even at a high operating temperature during its non-load operation, and a freedom from breakage or cracking of the segments during the storage of the grinding wheel.

(4) A grinding wheel of segmental type according to any one of the above modes (1)–(3) which is operable at a peripheral speed of not lower than 4800 m/mm.

The segmental type grinding wheel according to the above mode (4) is capable of performing a grinding operation at a comparatively high peripheral speed suitable for the specific material and shape of the workpiece.

(5) A grinding wheel of segmental type according to any one of the above modes (1)–(4), wherein the inner core portion is formed of a titanium alloy.

BRIEF DESCRIPTION OF THE INVENTION

The above and other objects, features, advantages and technical and industrial significance of the present invention will be better understood by reading the following detailed description of a preferred embodiment of the invention, when considered in connection with the accompanying drawings, in which.

Figure 4:
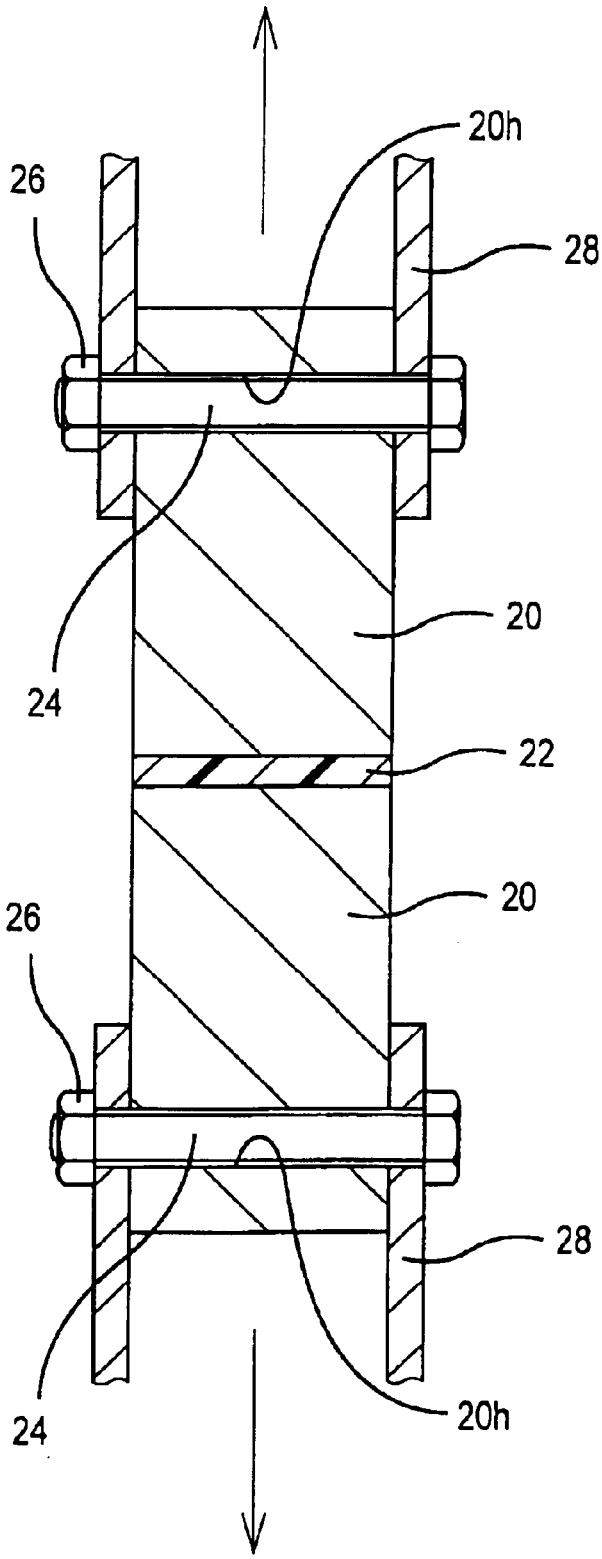
Figure 5:
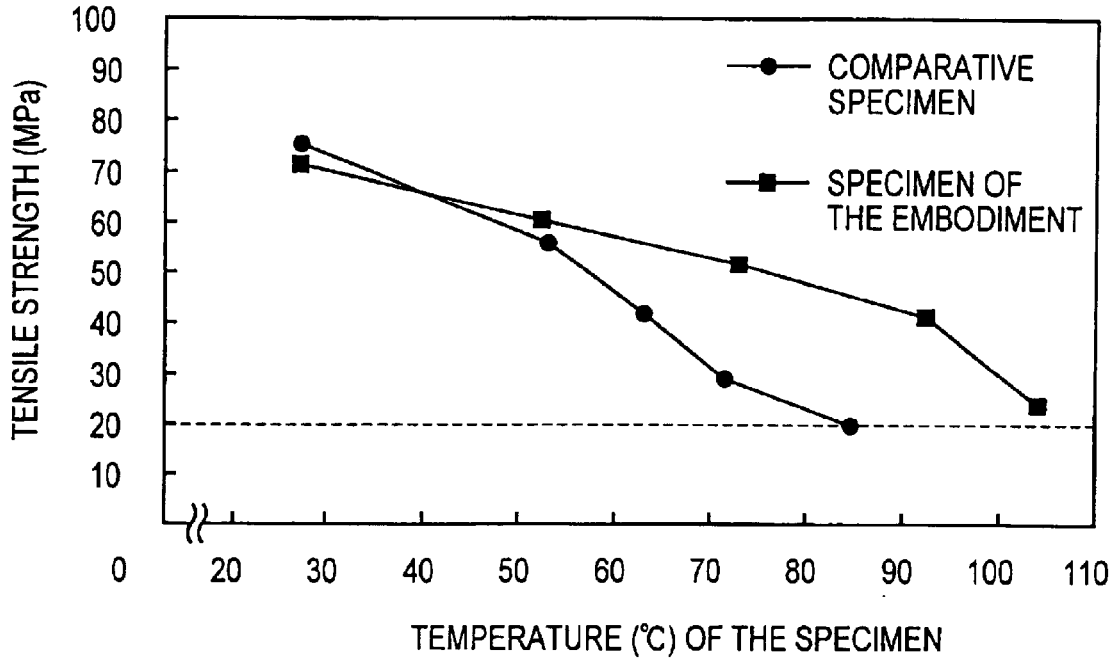

FIG. 4 is a cross sectional view of a specimen used in an experiment conducted by the present inventors to confirm an advantage of the present invention; and FIG. 5 is a graph indicating a relationship between a temperature (° C.) and a tensile strength (MPa) of a synthetic resin layer of a comparative specimen and a specimen according to the embodiment of the invention, which was obtained in the experiment.

DETAILED DESCRIPTION OF THE PREFERRED EMBODIMENT

The preferred embodiment of the present invention will be described in detail by reference to the accompanying drawings. It is to be understood, however, that FIGS. 2–4 do not necessarily show various parts or elements, with exact representation of ratios of their dimensions.

Figure 1:
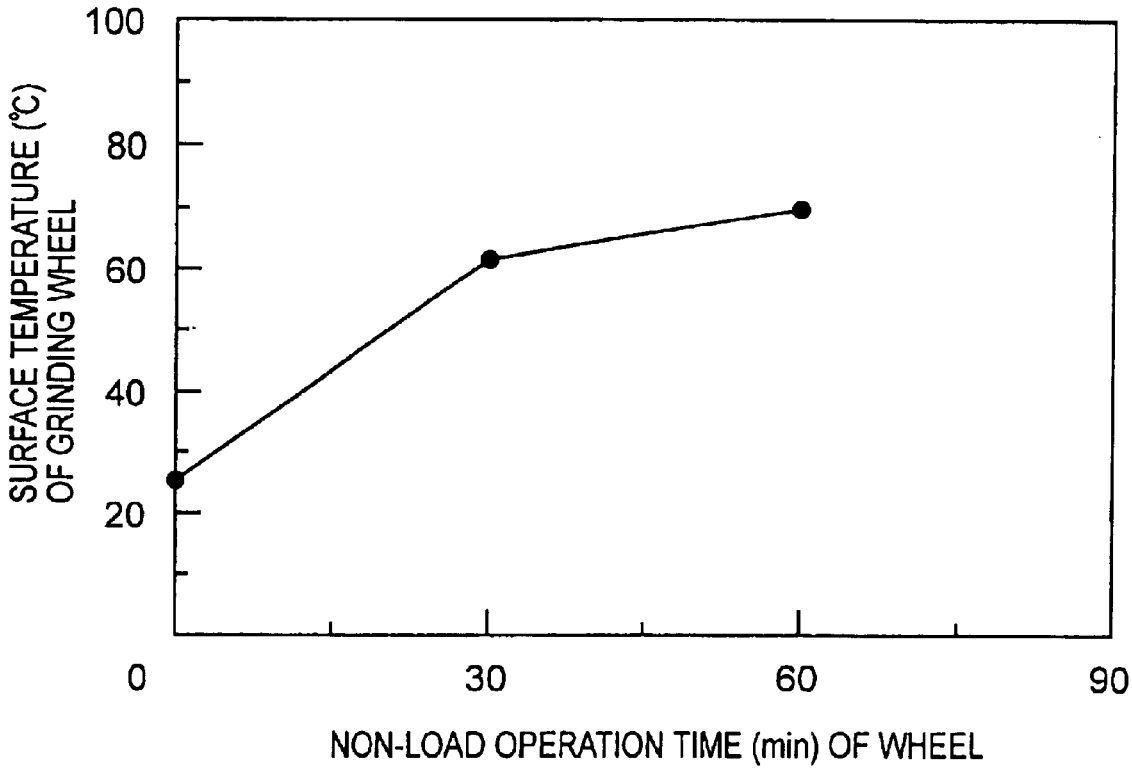
FIG. 1 is a graph indicating a relationship between a time (min) of operation of a grinding wheel under a non-load condition at a peripheral speed of 12000 m/min and a temperature (° C.) at the surface of the grinding wheel.
Figure 2:
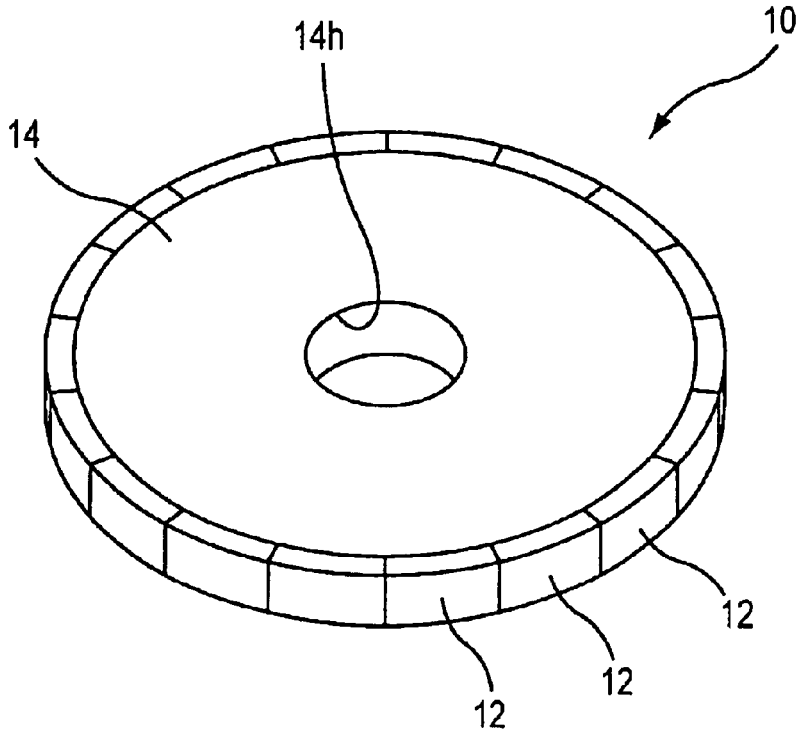
FIG. 2 is a perspective view of a segmental type grinding wheel constructed according to one embodiment of this invention.
Figure 3:
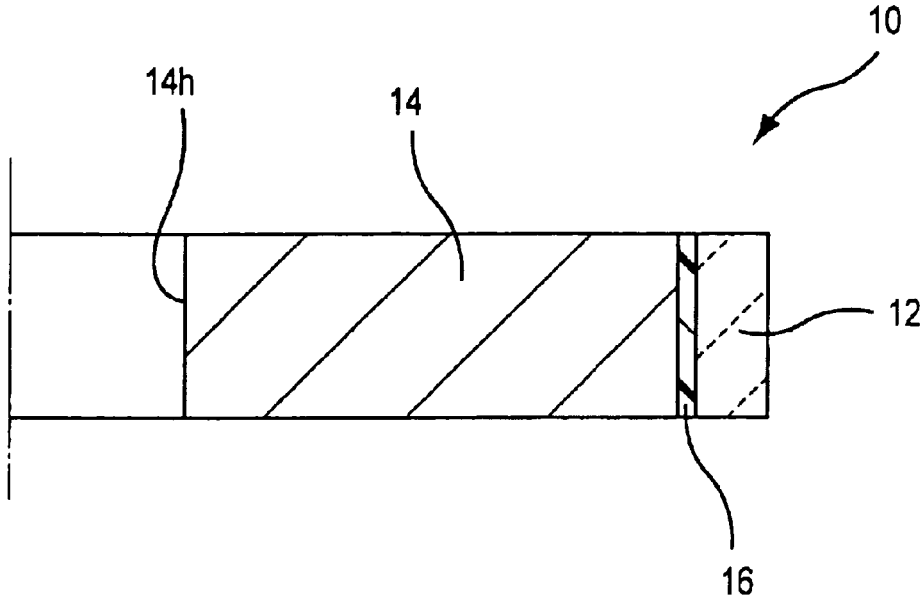
FIG. 3 is a fragmentary elevational view in cross section taken in a plane including an axis of rotation of the segmental type grinding wheel of FIG. 1.

Referring first to the perspective view of FIG. 2, there is shown a grinding wheel 10 of segmental type constructed according to the preferred embodiment of this invention. This segmental type grinding wheel 10 is shown in detail in the fragmentary elevational view of FIG. 3 in cross section taken in a plane including its axis of rotation. As shown in FIGS. 1 and 2, the segmental type grinding wheel 10 according to the present embodiment includes an inner annular or cylindrical core portion 14 having a central mounting hole 14*h* formed threrethrough, and a grinding portion consisting of a circular or annular array of a plurality of arcuate or part-cylindrical segments 12 which include respective layers of abrasive grains and which are bonded to the outer circumferential surface of the core portion 14 with a circumferential synthetic resin layer 16, which is interposed between the grinding portion and the core portion 14. For example, the grinding wheel 10 has an outside diameter of 250 mm (which is an outside diameter of the grinding portion), an axial dimension of 16 mm, and an inside diameter of 20 mm (which is a diameter of the central mounting hole 14*h*). Each of the arcuate or part-cylindrical segments 12 is formed of super abrasives such as diamond abrasives or CBN abrasives, or ordinary abrasives such as alumina abrasives or silicon carbide abrasives, which are bonded together with a glass bonding or binding agent. The core portion 14 is formed of a suitable material such as a titanium alloy or a ceramic material. The grinding wheel 10 is designed to perform a grinding operation at a peripheral speed of 4800 m/min or higher, and is suitable for a highly efficient grinding operation or a rough grinding operation.

To prevent drawbacks such as breakage or cracking of the segments 12 after hardening or curing of the synthetic resin layer 16 in the present segmental type grinding wheel 10, the following formula must be satisfied at an expected lowest temperature T (° C.) of the grinding wheel 10:

$$\sigma \leqq \sigma_{seg}$$

In the above formula, "σ" represents a compressive strain (MPa) induced in the segments 12 while "$\sigma_{seg}$" represents a compressive strength of the segments 12. The compressive strain σ of the segments 12 at the expected lowest temperature T (° C.) is represented by the following equation (1):

$$\sigma=|(\alpha_{cor}-\alpha_{seg})|\times E_{seg}\times|(T-T_{pla})| \quad (1)$$

wherein, $\alpha_{seg}$: Linear thermal expansion coefficient of the segments 12:

$E_{seg}$ (MPa): Elastic modulus of the segments 12;

$\sigma_{seg}$ (MPa): Compressive strength of the segments 12;

$\alpha_{cor}$ (°/C.): Linear thermal expansion coefficient of the core portion 14;

$T_{pla}$ (°/C.): Curing temperature of the synthetic resin layer 16

Generally, the segments 12 have an elastic modulus $E_{seg}$ of about $4\times10^4$ (MPa), and a compressive strength $\pi_{seg}$ of about 25 (MPa). In this case, an optimum absolute value $|(\alpha_{cor}-\alpha_{seg})|$ of a difference between the linear thermal expansion coefficient $\alpha_{seg}$ of the segments 12 and the linear thermal expansion coefficient $\alpha_{cor}$ of the core portion 14 may be obtained according to the following formula (2), where the above-indicated values $4\times10^4$ (MPa) and 25 (MPa), and the curing temperature $T_{pla}$ of about 70° C. of the synthetic resin layer 16 and the expected lowest temperature T of about −30° C. of the grinding wheel 10 are inserted in the above-indicated equation (1):

$$|(\alpha_{cor}-\alpha_{seg})|\leqq 6\times10^{-6} \quad (2)$$

Where the linear thermal expansion coefficient $\alpha_{seg}$ of the segments 12 and the linear thermal expansion coefficient $\alpha_{cor}$ of the core portion 14 satisfy the above-indicated formula (2), the segments 12 will not suffer from breakage, cracking or other drawbacks, even when the synthetic resin layer 16 is cured in an atmosphere having a temperature of 70° C. or higher, since the compressive strain σ of the segments 12 due to their thermal contraction during their cooling from the curing temperature is smaller than the compressive strength $\alpha_{seg}$ of the segments 12.

The synthetic resin layer 16 may have a curing temperature T higher than about 70° C. Where the synthetic resin layer 16 is formed of a one-liquid type synthetic resin bonding agent such as an epoxy resin, the curing temperature is 90° C. or higher. In this case, the linear thermal expansion coefficient $\alpha_{seg}$ of the segments 12 and the linear thermal expansion coefficient $\alpha_{cor}$ of the core portion 14 preferably satisfy the following formula (3):

$$|(\alpha_{cor}-\alpha_{seg})|\leqq 5\times10^{-6} \quad (3)$$

Where the linear thermal expansion coefficient $\alpha_{seg}$ of the segments 12 and the linear thermal expansion coefficient $\alpha_{cor}$ of the core portion 14 satisfy the above-indicated formula (3), the segments 12 will not suffer from breakage, cracking or other drawbacks, even when the synthetic resin layer 16 is cured in an atmosphere having a temperature of 90° C. or higher, since the compressive strain σ of the segments 12 due to their thermal contraction during their cooling from the curing temperature is smaller than the compressive strength $\sigma_{seg}$ of the segments 12.

There will be described an experiment conducted by the present inventors to confirm an advantage of the present invention. Two specimens were prepared by curing a synthetic resin layer formed of an epoxy resin bonding agent of two-liquid mixture type, at 50° C. and 100° C., respectively. The two specimens consist of a comparative specimen whose synthetic resin layer was cured at 50° C., and a specimen of the present embodiment whose synthetic resin layer was cured at 100° C. The tensile strength (MPa) of the synthetic resin layer of each of these specimens was measured at different temperatures of the layer. To obtain a relationship between the tensile strength (MPa) and the temperature of the synthetic resin layer of each specimen, two metal blocks 20 were bonded to each other with the synthetic resin layer 22 (two-liquid mixture type epoxy resin bonding agent), as shown in the cross sectional view of FIG. 4. Each metal block 20 has a through-hole 20*h*, and a length of 10 mm, a width of 10 mm and a height of 25 mm. The epoxy resin bonding agent was cured at 50° C. to form the synthetic resin layer 22 in the comparative specimen, while the epoxy resin bonding agent was cured at 100° C. to form the synthetic resin layer 22 in the specimen of the embodiment. A metallic jig 28 was attached to each of the two metal blocks 20, with a bolt 24 inserted through the through-hole 20*h*, and a nut 26 screwed on the bolt 24, as shown in FIG. 4. In the experiment, the two metal blocks 20 of each specimen were pulled in the opposite directions as indicated by arrow-headed lines, at a rate of about 1 mm per minute.

The graph of FIG. 5 indicates a result of the experiment described above, that is, a relationship between the temperature (° C.) and the tensile strength (MPa) of the synthetic resin layer 22. A dashed line in the graph indicates a lower limit of a required strength of bonding between the segments 12 and the core portion 14 of the segmental type grinding wheel 10. In the experiment, the temperature of the synthetic resin layer 22 was raised until the tensile strength decreased down to a level corresponding to the lower limit of the bonding strength, namely, down to 20 MPa. It will be understood from the graph that the synthetic resin layers 22 of the comparative specimen and the specimen of the embodiment exhibited almost the same tensile strength at comparatively low temperatures within a range of about 30–50° C., but the synthetic resin layer 22 of the specimen of the embodiment was about 1.8 times that of the comparative specimen at a temperature as high as about 70° C. It will also be understood that the tensile strength of the synthetic resin layer 22 of the comparative specimen was reduced down to 20 MPa when the temperature was raised to about 85° C., while the tensile strength of the synthetic resin layer 22 of the specimen according to the embodiment maintained about 25 MPa even at a temperature of about 105° C. Thus, the experiment confirmed that a rate of reduction of the tensile strength of the synthetic resin layer 22 cured at the comparatively high temperature of 100° C. according to the present embodiment was considerably lower than that of the synthetic resin layer 22 cured at the comparatively low temperature of 50° C., with respect to the increase in the temperature of the synthetic resin layer 22, and that the synthetic resin layer 22 of the specimen of the present embodiment maintained a sufficiently high tensile strength even at a high temperature close to the curing temperature.

The present inventors then investigated a relationship between the linear thermal expansion coefficient of the material of the core portion 14 and the breakage or cracking of the segments 12. Namely, the inventors prepared two specimens of the core portion 14 of the same dimensions, by using a steel material having a linear thermal expansion coefficient of $12\times10^{-6}$(/° C.) and a titanium alloy having a linear thermal expansion coefficient of $8.8\times10^{-6}$(/° C.), respectively. The segments 12 having a linear thermal expansion coefficient of about $5\times10^{-6}$(/° C.) were bonded to the outer circumferential surface of the core portion 14 of each specimen, with a two-liquid mixture type epoxy resin bonding agent. The epoxy resin bonding agent was cured in an atmosphere having a temperature of about 100° C. The core portion 14 had an outside diameter of 236 mm, an axial dimension of 16 mm and an inside diameter (hole diameter) of 20 mm, while each of the segments 12 bonded to the outer circumferential surface of the core portion 14 had an axial dimension of 16 mm, a radial thickness of 7 mm and a circumferential dimension of 39 mm, which are measured in the respective axial, radial and circumferential directions of the core portion 14. In the present example, the twenty segments 12 constituted an annular array bonded to the outer circumferential surface of the core portion 14. The temperature of the thus prepared specimens of the segmental type grinding wheel 10 was gradually reduced down to about −30° C., and the segments 12 were observed for breakage or cracking during the temperature reduction.

The experiment described above revealed an occurrence of breakage of the segments 12 at a temperature of about −20° C. in the segmental type grinding wheel 10 wherein the core portion 14 was formed of the steel material having the linear thermal expansion coefficient of $12\times10^{-6}$(/° C.), but no occurrence of breakage of the segments 12 even at a temperature of about −30° C. in the segmental type grinding wheel 10 wherein the core portion 14 was formed of the titanium alloy having the linear thermal expansion coefficient of $8.8\times10^{-6}$(/° C.). Thus, the experiment confirmed that the segments 12 do not suffer from breakage or cracking at a considerably low temperature, even where the synthetic resin layer 16 is cured in an atmosphere having a comparatively high temperature, provided the linear thermal expansion coefficient $\alpha_{seg}$ of the segments 12 and the linear thermal expansion coefficient $\alpha_{cor}$ of the core portion 14 are determined so as to satisfy the above-indicated formula (2), more preferably, the above-indicated formula (3).

In the present embodiment wherein the linear thermal expansion coefficient $\alpha_{seg}$ of the segments 12 and the linear thermal expansion coefficient $\alpha_{cor}$ of the core portion 14 are determined to be sufficiently close to each other, so as to satisfy the above-indicated formula (2), that is, $|(\alpha_{cor}-\alpha_{seg})|\leqq6\times10^{-6}$, the segments 12 will not be subjected to an excessive amount of compressive strain, even where the synthetic resin bonding agent of the synthetic resin layer 16 is cured in an atmosphere having a comparatively high temperature, so that the segments 12 will not suffer from breakage, cracking or any other drawbacks. Accordingly, the segmental type grinding wheel 10 according to the present embodiment has a sufficiently high degree of operating safety at an elevated temperature during its non-load operation, for example, and does not suffer from breakage or cracking during storage thereof, for example.

Preferably, the linear thermal expansion coefficient $\alpha_{seg}$ of the segments 12 and the linear thermal expansion coefficient $\alpha_{cor}$ of the core portion 14 are determined so as to satisfy the above-indicated formula (3), that is, $|(\alpha_{cor}-\alpha_{seg})|\leqq5\times10^{-6}$. This preferred arrangement prevents breakage or cracking of the segments 12 due to an excessive compressive strain, even where the synthetic resin bonding agent is cured in an atmosphere having a temperature of 90° C. or higher. According to this arrangement, the segmental type grinding wheel 10 has a sufficiently high degree of operating safety even upon rising of its temperature to a level as high as about 90° C. during its non-load operation, and is free from breakage or cracking of its segments 12 during its storage.

The synthetic resin layer 16 is preferably formed of an epoxy resin bonding agent which is cured in an atmosphere having a temperature of 70° C. or higher. This comparatively high curing temperature permits the synthetic resin layer 16 to provide a sufficiently high bonding force, assuring a high degree of operating safety of the grinding wheel 10 even at a high operating temperature during its non-load operation, and a freedom from breakage or cracking of the segments 12 during the storage of the grinding wheel 10.

The segmental type grinding wheel 10 is preferably designed to be operable to perform a grinding operation at a comparatively high peripheral speed of 4800 m/min or higher, which is suitable for the specific material and shape of the workpiece.

While the preferred embodiment of the present invention has been described above for illustrative purpose only, by reference to the accompanying drawings, it is to be understood that the invention is not limited to the details of the illustrated embodiment, but may be otherwise embodied.

In the illustrated embodiment, the core portion 14 is formed of a titanium alloy or a ceramic material. However, the core portion 14 may be formed of any other suitable material, provided the linear thermal expansion coefficient $\alpha_{seg}$ of the segments 12 and the linear thermal expansion coefficient $\alpha_{cor}$ of the core portion 14 are determined so as to satisfy the above-indicated formula (2), that is, $|(\alpha_{cor}-\alpha_{seg})|\leqq6\times10^{-6}$.

In the segmental type grinding wheel 10 according to the illustrated embodiment, the segments 12 are bonded to the outer circumferential surface of the cylindrical or annular core portion 14 with an epoxy resin bonding agent. However, the segments 12 may be bonded to the outer circumferential surface of the core portion 14, with any other synthetic resin bonding agent that is cured in an atmosphere having a comparatively high temperature of 70° C. or higher, for example.

In the illustrated embodiment, the synthetic resin layer 16 is cured at a temperature of not lower than 70° C. However, the synthetic resin layer 16 may be cured at a temperature lower than 70° C., for example, at 65° C., where the required strength of bonding between the segments 12 and the core portion 14 is not so high.

While the presently preferred embodiment of this invention has been described in detail by reference to the drawings, for illustrative purpose only, it is to be understood that the present invention may be embodied with various other changes, modifications and improvements, which may occur to those skilled in the art, in the light of the technical teachings of the present invention which have been described.

What is claimed is:

1. A grinding wheel of segmental type including an inner cylindrical core portion, and an outer grinding portion consisting of a plurality of segments which have abrasive layers formed of abrasive grains bonded together with a glass bonding agent and which are bonded to an outer circumferential surface of said core portion with a synthetic resin layer interposed therebetween, wherein an improvement comprises:

said plurality of segments having a linear thermal expansion coefficient $\alpha_{seg}$ (/° C.) while said core portion having a linear thermal expansion coefficient $\alpha_{cor}$ (/° C.), said linear thermal expansion coefficient $\alpha_{seg}$ (/° C.) and said linear thermal expansion coefficient $\alpha_{cor}$ (/° C.) satisfying a formula $|(\alpha_{cor}-\alpha_{seg})|\leqq6\times10^{-6}$; and said synthetic resin layer being formed of an enoxy resin bonding agent cured in an atmosphere having a temperature not lower than 70° C.

2. A grinding wheel of segmental type according to claim 1, wherein said linear thermal expansion coefficient $\alpha_{seg}$ (/° C.) and said linear thermal expansion coefficient $\alpha_{cor}$ (/° C.) satisfy a formula $|(\alpha_{cor}-\alpha seg)|\leqq5\times10^{-6}$.

3. A grinding wheel of segmental type according to claim 1, which is operable at a peripheral speed of not lower than 4800 m/min.

4. A grinding wheel of segmental type according to claim 1, wherein said inner core portion is formed of a titanium alloy.

* * * * *